US010770207B2

(12) United States Patent
Kume et al.

(10) Patent No.: US 10,770,207 B2
(45) **Date of Patent: *Sep. 8, 2020**

(54) RARE-EARTH PERMANENT MAGNET AND METHOD FOR MANUFACTURING RARE-EARTH PERMANENT MAGNET

(71) Applicant: NITTO DENKO CORPORATION, Ibaraki-shi, Osaka (JP)

(72) Inventors: Katsuya Kume, Ibaraki (JP); Toshiaki Okuno, Ibaraki (JP); Izumi Ozeki, Ibaraki (JP); Tomohiro Omure, Ibaraki (JP); Takashi Ozaki, Ibaraki (JP); Keisuke Taihaku, Ibaraki (JP); Takashi Yamamoto, Ibaraki (JP)

(73) Assignee: NITTO DENKO CORPORATION, Ibaraki-Shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/233,286

(22) PCT Filed: Mar. 8, 2013

(86) PCT No.: PCT/JP2013/056433

§ 371 (c)(1),
(2) Date: Jan. 16, 2014

(87) PCT Pub. No.: WO2013/137134

PCT Pub. Date: Sep. 19, 2013

(65) Prior Publication Data

US 2014/0145808 A1 May 29, 2014

(30) Foreign Application Priority Data

Mar. 12, 2012 (JP) ..... 2012-054695
Mar. 12, 2012 (JP) ..... 2012-054696
(Continued)

(51) Int. Cl.
*H01F 1/053* (2006.01)
*B22F 1/00* (2006.01)
(Continued)

(52) U.S. Cl.
CPC ..... *H01F 1/0536* (2013.01); *B22F 1/0059* (2013.01); *B22F 3/18* (2013.01);
(Continued)

(58) Field of Classification Search
CPC ..... H01F 1/0536; H01F 41/0266; B22F 3/12; C04B 35/64
(Continued)

(56) References Cited

U.S. PATENT DOCUMENTS 4,313,986 A * 2/1982 Magnotta ..... C09J 7/0246 428/202
4,683,267 A * 7/1987 Lindner ..... C08L 59/02 525/133
(Continued)

FOREIGN PATENT DOCUMENTS

CN 101379574 A 3/2009
CN 101978445 A 2/2011
(Continued)

OTHER PUBLICATIONS

JP 2007-327102 machine translation (Year: 2007).*
(Continued)

*Primary Examiner* — Paul A Wartalowicz
*Assistant Examiner* — Stephani Hill
(74) *Attorney, Agent, or Firm* — Hauptman Ham, LLP

(57) ABSTRACT

There are provided a rare-earth permanent magnet and a manufacturing method of a rare-earth permanent magnet capable of preventing deterioration of magnet properties. In the method, magnet material is milled into magnet powder. Next, a mixture 12 is prepared by mixing the magnet powder
(Continued)

and a binder, and the mixture 12 is formed into a sheet-like shape to obtain a green sheet 14. Thereafter, magnetic field orientation is performed to the green sheet 14, which is then held for several hours in a non-oxidizing atmosphere at a pressure higher than normal atmospheric pressure, at 200 through 900 degrees Celsius for calcination. Thereafter, the calcined green sheet 14 is sintered at a sintering temperature. Thereby a permanent magnet 1 is manufactured.

15 Claims, 9 Drawing Sheets

(30) Foreign Application Priority Data

Mar. 12, 2012 (JP) ..... 2012-054697
Mar. 12, 2012 (JP) ..... 2012-054698

(51) Int. Cl.

| | |
|---|---|
| ***H01F 1/057*** | (2006.01) |
| ***H01F 1/08*** | (2006.01) |
| ***B22F 3/18*** | (2006.01) |
| ***B22F 7/04*** | (2006.01) |
| ***C22C 38/00*** | (2006.01) |
| ***H01F 41/02*** | (2006.01) |

(52) U.S. Cl.
CPC ..... *B22F 7/04* (2013.01); *C22C 38/002* (2013.01); *C22C 38/005* (2013.01); *H01F 1/0577* (2013.01); *H01F 1/086* (2013.01); *H01F 41/0266* (2013.01); *B22F 2003/185* (2013.01); *B22F 2301/355* (2013.01); *B22F 2999/00* (2013.01)

(58) Field of Classification Search
USPC ..... 335/302; 419/33, 32
See application file for complete search history.

(56) References Cited

U.S. PATENT DOCUMENTS

| | | | | |
|---|---|---|---|---|
| 4,996,022 | A * | 2/1991 | Shindo | B22F 3/1021 419/2 |
| 5,427,734 | A * | 6/1995 | Yamashita | B22F 3/22 419/23 |
| 5,432,224 | A * | 7/1995 | Ryuhgoh | B22F 1/0059 501/94 |
| 6,376,585 | B1 * | 4/2002 | Schofalvi | B22F 1/0059 524/195 |
| 6,451,221 | B1 | 9/2002 | Hart et al. | |
| 8,128,758 | B2 | 3/2012 | Nozawa et al. | |
| 2002/0084439 | A1 * | 7/2002 | Hart | H01F 1/0558 252/62.54 |
| 2003/0063993 | A1 * | 4/2003 | Reiter, Jr. | B22F 3/225 419/36 |
| 2003/0190250 | A1 * | 10/2003 | Mori | B22F 3/1007 419/58 |
| 2009/0032147 | A1 * | 2/2009 | Nozawa | B22F 3/11 148/302 |
| 2011/0012700 | A1 * | 1/2011 | Ozeki | H01F 1/0552 335/302 |
| 2011/0121498 | A1 * | 5/2011 | Irie | B22F 3/1021 264/612 |
| 2011/0314964 | A1 * | 12/2011 | Ishigami | C08L 25/06 75/228 |
| 2012/0182109 | A1 * | 7/2012 | Ozeki | C22C 33/02 335/302 |
| 2013/0285778 | A1 | 10/2013 | Taihaku et al. | |

FOREIGN PATENT DOCUMENTS

| | | | |
|---|---|---|---|
| EP | 0 663 672 | A2 | 7/1995 |
| EP | 2 256 758 | A1 | 12/2010 |
| JP | 2-266503 | A | 10/1990 |
| JP | 5-135978 | A | 6/1993 |
| JP | 6-116605 | A | 4/1994 |
| JP | 9-283358 | A | 10/1997 |
| JP | H09-283358 | * | 10/1997 |
| JP | 2002-164203 | A | 6/2002 |
| JP | 2003-26928 | A | 1/2003 |
| JP | 2004-146713 | A | 5/2004 |
| JP | 2004-281873 | A | 10/2004 |
| JP | 2005-203555 | A | 7/2005 |
| JP | 2007-266038 | A | 10/2007 |
| JP | 2007327102 | A * | 12/2007 |
| KR | 10-2010-0127233 | A | 12/2010 |
| WO | 03/004580 | A1 | 1/2003 |
| WO | 2009/116539 | A1 | 9/2009 |
| WO | 2011/125595 | A1 | 10/2011 |
| WO | 2012/176509 | A1 | 12/2012 |

OTHER PUBLICATIONS

JP H09-283358 machine translation (Year: 1997).*
Notification of the First Office Action dated Jan. 21, 2016 from The State Intellectual Property Office of P.R. China in counterpart Application No. 201380004067.6.
Extended European Search Report dated Dec. 17, 2015, from the European Patent Office in counterpart European Application No. 13761122.4.
Notification of Grounds for Rejection dated Mar. 1, 2016 from Japanese Patent Office in Application No. 2012-054695.
Notification of Grounds for Rejection dated Mar. 1, 2016 from Japanese Patent Office in Application No. 2012-054696.
Notification of Grounds for Rejection dated Mar. 1, 2016 from Japanese Patent Office in Application No. 2012-054697.
Communication dated Jun. 23, 2016 from the Taiwanese Intellectual Property Office in counterpart application No. 102108735.
Notification of Ground for Rejection dated Aug. 3, 2016, issued by the Korean Intellectual Property Office in corresponding Korean Application No. 10-2014-7004671.
Communication dated Feb. 28, 2017, from the European Patent Office in counterpart European Application No. 13761122.4.
Notification of Second Office Action dated Nov. 22, 2016 from the State Intellectual Property Office of the P.R.C. in counterpart Application No. 201380004067.6.
Notice of Decision for Final Rejection dated Nov. 24, 2016 from the Korean Intellectual Property Office in counterpart Application No. 10-2014-7004671.
Notification of the Third Office Action dated Jul. 21, 2017, issued by the State Intellectual Property Office of the P.R.C. in corresponding Chinese Application No. 201380004067.6.
Notification of First Office Action dated Feb. 13, 2018 from the Korean Intellectual Property Office in counterpart Application No. 10-2016-7036329.
Notice of Decision for Final Rejection dated Sep. 21, 2018 from the Korean Intellectual Property Office in counterpart Application No. 10-2016-7036329.
Notice of Decision for Final Rejection dated Jan. 2, 2019 from Korean Intellectual Property Office in counterpart KR Application No. 10-2016-7036329.
Examination Report dated Apr. 24, 2019, from the Intellectual Property Office of India in counterpart application No. 162/CHENP/2014.
Notification of Ground for Rejection dated May 9, 2019, from the Korean Intellectual Property Office in counterpart application No. 10-2019-7009509.
Notice of Final Rejection issued for corresponding Korean Patent Application No. 10-2019-7009509 dated Feb. 18, 2020, along with an English translation.
International Search Report for PCT/JP2013/056433 dated Jun. 11, 2013.

(56) References Cited

OTHER PUBLICATIONS

Korean Office Action for corresponding Korean application No. 10-2020-7016346 dated Jun. 13, 2020.

* cited by examiner

FIG. 9

| | BINDER RESIN | PRESSURE AT CALCINATION | OXYGEN CONCENTRATION [ppm] | CARBON CONCENTRATION [ppm] | RESIDUAL MAGNETIC FLUX DENSITY Br [kG] | COERCIVE FORCE Hcj [kOe] |
|---|---|---|---|---|---|---|
| EMBODIMENT 1 | POLYISOBUTYLENE (PIB) | 0.5MPa | 1200 | 210 | 12.0 | 13.0 |
| EMBODIMENT 2 | STYRENE-ISOPRENE COPOLYMER (SIS) | 0.5MPa | 1250 | 250 | 11.7 | 12.5 |
| EMBODIMENT 3 | POLYISOPRENE (IR) | 0.5MPa | 1200 | 360 | 11.8 | 13.2 |
| EMBODIMENT 4 | POLYBUTADIENE (BR) | 0.5MPa | 1180 | 360 | 12.2 | 13.3 |
| EMBODIMENT 5 | STYRENE-BUTADIENE COPOLYMER (SBS) | 0.5MPa | 1300 | 360 | 11.7 | 11.5 |
| COMPARATIVE EXAMPLE 1 | POLYISOBUTYLENE (PIB) | ATMOSPHERIC PRESSURE | 1150 | 400 | 10.0 | 6.5 |
| COMPARATIVE EXAMPLE 2 | STYRENE-ISOPRENE COPOLYMER (SIS) | ATMOSPHERIC PRESSURE | 1170 | 300 | 9.8 | 7.0 |
| COMPARATIVE EXAMPLE 3 | POLYISOPRENE (IR) | ATMOSPHERIC PRESSURE | 1150 | 1500 | 10.0 | 5.0 |
| COMPARATIVE EXAMPLE 4 | POLYBUTADIENE (BR) | ATMOSPHERIC PRESSURE | 1100 | 800 | 9.5 | 5.5 |
| COMPARATIVE EXAMPLE 5 | STYRENE-BUTADIENE COPOLYMER (SBS) | ATMOSPHERIC PRESSURE | 1130 | 500 | 9.8 | 6.0 |
| COMPARATIVE EXAMPLE 6 | POLYISOBUTYLENE (PIB) | NOT CALCINED | 1150 | 3950 | 7.0 | 1.0 |
| COMPARATIVE EXAMPLE 7 | POLY BUTYL METHACRYLATE | ATMOSPHERIC PRESSURE | 9000 | 500 | 5.5 | 3.0 |

RARE-EARTH PERMANENT MAGNET AND METHOD FOR MANUFACTURING RARE-EARTH PERMANENT MAGNET

CROSS REFERENCE TO RELATED APPLICATIONS

This application is a National Stage of International Application No. PCT/JP2013/056433 filed Mar. 8, 2013, claiming priority based on Japanese Patent Application Nos. 2012-054695, 2012-054696, 2012-054697, 2012-054698 filed Mar. 12, 2012, the contents of all of which are incorporated herein by reference in their entirety.

TECHNICAL FIELD

The present invention relates to a rare-earth permanent magnet and a method for manufacturing the rare-earth permanent magnet.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, film-thinning and a further improvement in magnetic performance have been required of a permanent magnet to be embedded in the permanent magnet motor.

As a method for manufacturing a permanent magnet, for instance, a powder sintering process may be used. In this powder sintering process, first, raw material is coarsely milled and then finely milled into magnet powder by a jet mill (dry-milling method) or a wet bead mill (wet-milling method). Thereafter, the magnet powder is put in a mold and pressed to form into a desired shape with a magnetic field applied from outside. Then, the magnet powder formed into the desired shape and solidified is sintered at a predetermined temperature (for instance, at a temperature between 800 and 1150 degrees Celsius for the case of Nd—Fe—B-based magnet) for completion (See, for instance, Japanese Laid-open Patent Application Publication No. 2-266503).

PRIOR ART DOCUMENT

Patent Document

Patent document 1: Japanese Laid-open Patent Application Publication No. 2-266503 (page 5)

DISCLOSURE OF THE INVENTION

Problem to be Solved by the Invention

Then, specifically in a rare-earth magnet, as a rare-earth element such as neodymium (Nd) has significantly high reactivity with carbon, carbide is formed if carbon-containing substances remain until a high-temperature stage in a sintering process. Consequently, there has been such a problem as thus formed carbide causes the sintered magnet to have a gap between a main phase and a grain boundary phase, so that the entirety of the magnet cannot be sintered densely and magnetic performance thereof is drastically degraded. Even if no gap is formed, the formed carbide still causes a problem of alpha iron separating out in a main phase of the sintered magnet, considerably degrading magnetic properties thereof.

The invention has been made in order to solve the above-mentioned conventional problems, and an object of the invention is to provide a rare-earth permanent magnet and a method for manufacturing the rare-earth permanent magnet in which the magnet powder or the formed body of magnet powder is calcined in a non-oxidizing atmosphere at a pressure higher than normal atmospheric pressure so that the carbon content in magnet particles can be reduced in advance, preventing the magnetic properties from deteriorating.

Means for Solving the Problem

To achieve the above object, the present invention provides a manufacturing method of a rare-earth permanent magnet comprising steps of: milling magnet material into magnet powder; forming the magnet powder into a formed body; calcining the formed body in a non-oxidizing atmosphere at a pressure higher than normal atmospheric pressure; and holding the calcined formed body at a sintering temperature so as to sinter the calcined formed body.

In the above-described manufacturing method of a rare-earth permanent magnet of the present invention, in the step of forming the magnet powder, the magnet powder is mixed with a binder to prepare a mixture, and the mixture is formed into a sheet-like shape to produce a green sheet as the formed body.

In the above-described manufacturing method of a rare-earth permanent magnet of the present invention, in the step of calcining the formed body, the binder is decomposed and removed from the green sheet by holding the green sheet for a predetermined length of time at a binder decomposition temperature in the non-oxidizing atmosphere at a pressure higher than normal atmospheric pressure.

In the above-described manufacturing method of a rare-earth permanent magnet of the present invention, in the step of calcining the formed body, the green sheet is held for the predetermined length of time within a temperature range of 200 degrees Celsius to 900 degrees Celsius in a hydrogen atmosphere or a mixed gas atmosphere of hydrogen and inert gas.

In the above-described manufacturing method of a rare-earth permanent magnet of the present invention, in the step of forming the magnet powder, the mixture is thermally melted and formed into a sheet-like shape.

In the above-described manufacturing method of a rare-earth permanent magnet of the present invention, the binder is made of a polymer or a copolymer consisting of monomers containing no oxygen atoms.

In the above-described manufacturing method of a rare-earth permanent magnet of the present invention, the binder comprises: polyisobutylene; or a styrene-isoprene copolymer.

In the above-described manufacturing method of a rare-earth permanent magnet of the present invention, in the step of milling magnet material, the magnet material is wet-milled in an organic solvent.

In the above-described manufacturing method of a rare-earth permanent magnet of the present invention, in the step of calcining the formed body, an organic compound included in the organic solvent thermally decomposes and carbon therein is removed, while the binder decomposes and is removed from the green sheet, by holding the green sheet for a predetermined length of time at a temperature being a binder decomposition temperature and also being a decomposition temperature of the organic compound.

To achieve the above object, the present invention provides a rare-earth permanent magnet manufactured through steps of: milling magnet material into magnet powder; forming the magnet powder into a formed body; calcining the formed body in a non-oxidizing atmosphere under a pressure higher than normal atmospheric pressure; and holding the calcined formed body at a sintering temperature so as to sinter the calcined formed body.

Effect of the Invention

According to the manufacturing method of a rare-earth permanent magnet of the present invention, it is made possible to manufacture a rare-earth permanent magnet in which carbon content in the magnet particles is reduced in advance, by calcining the formed body of the magnet powder in a non-oxidizing atmosphere at a pressure higher than normal atmospheric pressure, before sintering. Consequently, the entirety of the magnet can be sintered densely without a gap between a main phase and a grain boundary phase in the sintered magnet, and decline of coercive force can be avoided. Further, considerable alpha iron does not separate out in the main phase of the sintered magnet and serious deterioration of magnetic properties can be avoided.

According to the manufacturing method of a rare-earth permanent magnet of the present invention, the rare-earth permanent magnet is produced by mixing magnet powder and a binder and forming the mixture to obtain a green sheet, and sintering the green sheet. Therefore, the thus sintered green sheet uniformly contracts so that deformations such as warpage and depressions do not occur in the sintered green sheet, and pressure can be uniformly applied thereto at pressurizing. Accordingly, no adjustment process is necessitated which has been conventionally performed after sintering, and manufacturing process can be simplified. Thereby, a permanent magnet can be manufactured with dimensional accuracy. Further, even if such permanent magnets are manufactured with thinner design, increase in the number of manufacturing processes can be avoided without lowering a material yield.

Further, by calcining the green sheet in a non-oxidizing atmosphere before sintering, carbon content in magnet particles can be reduced in advance. Consequently, the entirety of the magnet can be sintered densely without a gap between a main phase and a grain boundary phase in the sintered magnet and decline of coercive force can be avoided. Further, considerable alpha iron can be prevented from separating out in the main phase of the sintered magnet and serious deterioration of magnetic properties can be avoided. Specifically, calcination in a non-oxidizing atmosphere with the pressure higher than normal atmospheric pressure can facilitate binder decomposition and removal. Thereby, the carbon content in magnet particles can further be reduced.

Further, according to the manufacturing method of a rare-earth permanent magnet of the present invention, before the step of sintering the green sheet, the binder is decomposed and removed from the green sheet by holding the green sheet for a predetermined length of time at binder decomposition temperature in a non-oxidizing atmosphere. Thereby, carbon content in the magnet can be reduced even if the binder has been mixed to the magnet powder.

Further, according to the manufacturing method of a rare-earth permanent magnet of the present invention, in the step of calcining, the green sheet with the binder mixed therein is calcined in a hydrogen atmosphere or a mixed gas atmosphere of hydrogen and inert gas, so that the contained carbon can be released from the magnet in a form of methane. Thereby, carbon content in the magnet can be reduced more reliably.

Further, according to the manufacturing method of a rare-earth permanent magnet of the present invention, the green sheet is formed through thermally melting the mixture, so that there is no possibility of an imbalanced distribution of liquid, in other words, of problematic unevenness in thickness of the green sheet at magnetic field orientation, contrary to the case of slurry molding. Further, the binder therein is well intermingled, so that no delamination occurs at a process of removing the binder.

Further, according to the manufacturing method of a rare-earth permanent magnet of the present invention, oxygen content in the sintered magnet can be reduced by using a resin made of a polymer or a copolymer of monomers containing no oxygen atoms, as the binder.

Further, according to the manufacturing method of a rare-earth permanent magnet of the present invention, oxygen content in the sintered magnet can be reduced by using, specifically, polyisobutylene or a styrene-isoprene copolymer, as the binder.

Further, according to the manufacturing method of a rare-earth permanent magnet of the present invention, the magnet material is mixed with an organic solvent in wet-milling and formed into a shape to obtain a green sheet, and by calcining the green sheet in a non-oxidizing atmosphere before sintering, carbon content in magnet particles can be reduced in advance. Consequently, the entirety of the magnet can be sintered densely without a gap between a main phase and a grain boundary phase in the sintered magnet and decline of coercive force can be avoided. Further, considerable alpha iron can be prevented from separating out in the main phase of the sintered magnet and serious deterioration of magnetic properties can be avoided. Specifically, calcination in a non-oxidizing atmosphere with the pressure higher than normal atmospheric pressure can facilitate decomposition and removal of an organic compound included in the organic solvent or the binder. Thereby, the carbon content in magnet particles can further be reduced.

Further, according to the manufacturing method of a rare-earth permanent magnet of the present invention, before the step of sintering the green sheet, the organic compound can thermally decompose and the carbon therein can be removed while the binder is released and removed from the green sheet, by holding the green sheet for a predetermined length of time at a temperature being a decomposition temperature of the organic compound composing the organic solvent and binder decomposition temperature in a non-oxidizing atmosphere. Thereby, even if the organic solvent or the binder has been mixed to the magnet powder, there is no significant increase in the carbon content in the magnet.

According to the rare-earth permanent magnet of the present invention, carbon content in the magnet particles can be reduced in advance, by calcining the formed body of the magnet powder in a non-oxidizing atmosphere at a pressure higher than normal atmospheric pressure, before sintering. Consequently, the entirety of the magnet can be sintered densely without a gap between a main phase and a grain boundary phase in the sintered magnet, and decline of coercive force can be avoided. Further, considerable alpha iron does not separate out in the main phase of the sintered magnet and serious deterioration of magnetic properties can be avoided.

BRIEF DESCRIPTION OF THE DRAWINGS

FIG. 9 is a table illustrating various measurement results of magnets according to embodiments and comparative examples, respectively.

BEST MODE FOR CARRYING OUT THE INVENTION

A specific embodiment of a rare-earth permanent magnet and a method for manufacturing the rare-earth permanent magnet according to the present invention will be described below in detail with reference to the drawings.

Constitution of Permanent Magnet

Figure 1:
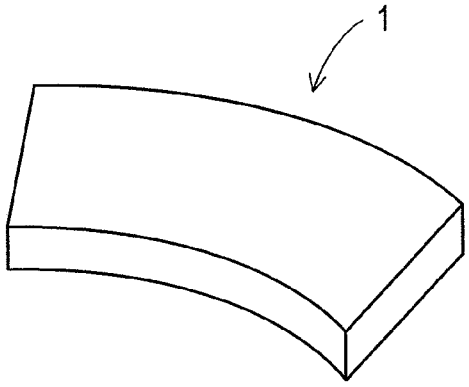
FIG. 1 is an overall view of a permanent magnet according to the invention.

First, a constitution of a permanent magnet 1 according to the present invention will be described. FIG. 1 is an overall view of the permanent magnet 1 according to the present invention. Incidentally, the permanent magnet 1 depicted in FIG. 1 has a fan-like shape; however, the shape of the permanent magnet 1 can be changed according to the shape of a cutting-die.

As the permanent magnet 1 according to the present invention, an Nd—Fe—B-based anisotropic magnet may be used. Incidentally, the contents of respective components are regarded as Nd: 27 to 40 wt %, B: 0.8 to 2 wt %, and Fe (electrolytic iron): 60 to 70 wt %. Furthermore, the permanent magnet 1 may include other elements such as Dy, Tb, Co, Cu, Al, Si, Ga, Nb, V, Pr, Mo, Zr, Ta, Ti, W, Ag, Bi, Zn or Mg in small amount, in order to improve the magnetic properties thereof. FIG. 1 is an overall view of the permanent magnet 1 according to the present embodiment.

The permanent magnet 1 as used herein is a thin film-like permanent magnet having a thickness of 0.05 to 10 mm (for instance, 1 mm), and is prepared by sintering a formed body formed through powder compaction or a formed body (a green sheet) obtained by forming a mixture (slurry or a powdery mixture) of magnet powder and a binder into a sheet-like shape, as described later.

In the present invention, a resin, a long-chain hydrocarbon, a fatty acid methyl ester or a mixture thereof is used as the binder to be mixed with the magnet powder, specifically in the case of manufacturing a permanent magnet 1 through green sheet formation.

Further, if a resin is used as the binder, the resin used is preferably polymers having no oxygen atoms in the structure and being depolymerizable. Meanwhile, in the case where later-described hot-melt molding is employed for producing the green sheet, a thermoplastic resin is preferably used for the convenience of performing magnetic field orientation using the produced green sheet in a heated and softened state. Specifically, an optimal polymer is a polymer or a copolymer of one or more kinds of monomers selected from monomers expressed with the following general formula (2):

[general formula 2]

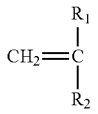

(2)

(wherein $R_1$ and $R_2$ each represent a hydrogen atom, a lower alkyl group, a phenyl group or a vinyl group).

Polymers that satisfy the above condition include: polyisobutylene (PIB) formed from isobutene polymerization, polyisoprene (isoprene rubber or IR) formed from isoprene polymerization, polybutadiene (butadiene rubber or BR) formed from butadiene polymerization, polystyrene formed from styrene polymerization, styrene-isoprene block copolymer (SIS) formed from copolymerization of styrene and isoprene, butyl rubber (IIR) formed from copolymerization of isobutylene and isoprene, styrene-butadiene block copolymer (SBS) formed from copolymerization of styrene and butadiene, Poly(2-methyl-1-pentene) formed from polymerization of 2-methyl-1-pentene, poly(2-methyl-1-butene) formed from polymerization of 2-methyl-1-butene, and poly (alpha-methylstyrene) formed from polymerization of alpha-methylstyrene. Incidentally, low molecular weight polyisobutylene is preferably added to the poly(alpha-methylstyrene) to produce flexibility. Further, resins to be used for the binder may include small amount of polymer or copolymer of monomers containing oxygen atoms (such as polybutylmethacrylate or polymethylmethacrylate). Further, monomers not satisfying the above general formula (2) may be partially copolymerized. Even in such a case, the purpose of this invention can be realized.

Incidentally, the binder is preferably made of a thermoplastic resin that softens at 250 degrees Celsius or lower, or specifically, a thermoplastic resin whose glass transition point or melting point is 250 degrees Celsius or lower.

Meanwhile, in a case a long-chain hydrocarbon is used for the binder, there is preferably used a long-chain saturated hydrocarbon (long-chain alkane) being solid at room temperature and being liquid at a temperature higher than the room temperature. Specifically, a long-chain saturated hydrocarbon having 18 or more carbon atoms is preferably used. In the case of employing the later-described hot-melt molding for forming the green sheet, the magnetic field orientation of the green sheet is performed under a state where the green sheet is heated and softened at a temperature higher than the melting point of the long-chain hydrocarbon.

In a case where a fatty acid methyl ester is used for the binder, there are preferably used methyl stearate, methyl docosanoate, etc., being solid at room temperature and being liquid at a temperature higher than the room temperature, similar to long-chain saturated hydrocarbon. In the case of using the later-described hot-melt molding when forming the green sheet, the magnetic field orientation of the green sheet is performed under a state where the green sheet is heated to be softened at a temperature higher than the melting point of fatty acid methyl ester.

Through using a binder that satisfies the above condition as binder to be mixed with the magnet powder when preparing the green sheet, the carbon content and oxygen content in the magnet can be reduced. Specifically, the carbon content remaining after sintering is made 2000 ppm or lower, or more preferably, 1000 ppm or lower. Further, the oxygen content remaining after sintering is made 5000 ppm or lower, or more preferably, 2000 ppm or lower.

Further, the amount of the binder to be added is an optimal amount to fill the gaps between magnet particles so that thickness accuracy of the sheet can be improved when forming the slurry or the heated and molten mixture into a sheet-like shape. For instance, the binder proportion to the amount of magnet powder and binder in total in the slurry after the addition of the binder is preferably 1 wt % through 40 wt %, more preferably 2 wt % through 30 wt %, still more preferably 3 wt % through 20 wt %.

Method for Manufacturing Permanent Magnet

Figure 2:
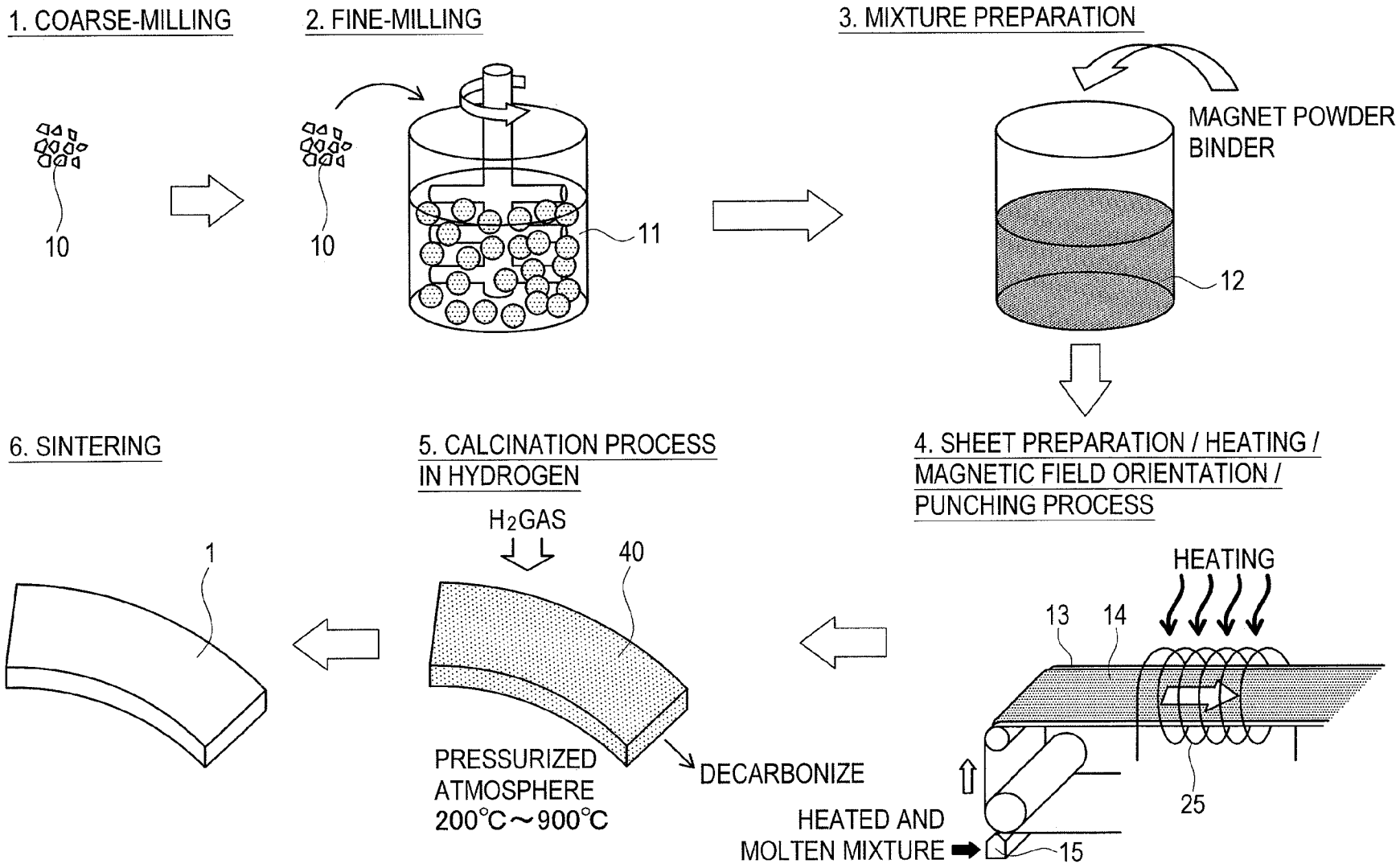
FIG. 2 is an explanatory diagram illustrating a manufacturing process of a permanent magnet according to the invention.

Next, a method for manufacturing the permanent magnet 1 according to the present invention will be described below with reference to FIG. 2. FIG. 2 is an explanatory view illustrating a manufacturing process of the permanent magnet 1 according to the present invention.

First, there is manufactured an ingot comprising Nd—Fe—B of certain fractions (for instance, Nd: 32.7 wt %, Fe (electrolytic iron): 65.96 wt %, and B: 1.34 wt %). Thereafter the ingot is coarsely milled using a stamp mill, a crusher, etc. to a size of approximately 200 μm. Otherwise, the ingot is melted, formed into flakes using a strip-casting method, and then coarsely milled using a hydrogen pulverization method. Thus, coarsely milled magnet powder 10 can be obtained.

Following the above, the coarsely milled magnet powder 10 is finely milled by a wet method using a bead mill 11 or a dry method using a jet mill, etc. For instance, in fine milling using a wet method by the bead mill 11, the coarsely milled magnet powder 10 is finely milled to a particle size within a predetermined range (for instance, 0.1 μm through 5.0 μm) in an organic solvent and the magnet powder is dispersed in the organic solvent. Thereafter, the magnet powder included in the organic solvent after the wet milling is dried by such a method as vacuum desiccation to obtain the dried magnet powder. The solvent to be used for milling is an organic solvent, but the type of the solvent is not specifically limited, and may include: alcohols such as isopropyl alcohol, ethanol and methanol; esters such as ethyl acetate; lower hydrocarbons such as pentane and hexane; aromatic series such as benzene, toluene and xylene; ketones; and a mixture thereof. However, there is preferably used a hydrocarbon-solvent including no oxygen atoms in the solvent.

In the fine-milling using the dry method with the jet mill, however, the coarsely milled magnet powder is finely milled in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%, with a jet mill, to form fine powder of which the average particle diameter is within a predetermined size range (for instance, 1.0 μm through 5.0 μm). Here, the term "having an oxygen content of substantially 0%" is not limited to a case where the oxygen content is completely 0%, but may include a case where oxygen is contained in such an amount as to allow a slight formation of an oxide film on the surface of the fine powder.

Thereafter, the magnet powder finely milled by the bead mill 11, etc. is formed into a desired shape. Incidentally, methods for formation of the magnet powder include powder compaction using a metal die to mold the magnet powder into the desired shape, and green sheet formation in which the magnet powder is first formed into a sheet-like shape and then the sheet-like magnet powder is punched out into the desired shape. Further, the powder compaction includes a dry method of filling a cavity with desiccated fine powder and a wet method of filling a cavity with slurry including the magnet powder without desiccation. Meanwhile, the green sheet formation includes, for instance, hot-melt molding in which a mixture of magnet powder and a binder is prepared and formed into a sheet-like shape, and slurry molding in which a base is coated with slurry including magnet powder, a binder and an organic solvent, to form the slurry into a sheet-like shape.

Hereinafter, the green sheet formation using hot-melt molding is discussed. First, a binder is added to the magnet powder finely milled by the jet mill or the like, to prepare a powdery mixture (a mixture) 12 of the magnet powder and the binder. Here, as mentioned above, there can be used a resin, a long-chain hydrocarbon, a fatty acid methyl ester or a mixture thereof as binder. For instance, when a resin is employed, it is preferable that the resin is made of a polymer or copolymer of monomers containing no oxygen atoms, and when a long-chain hydrocarbon is employed, it is preferable that a long-chain saturated hydrocarbon (long-chain alkane) is used. In a case where a fatty acid methyl ester is used for the binder, there are preferably used methyl stearate, methyl docosanoate, etc. Here, as mentioned above, the amount of binder to be added is preferably such that binder proportion to the amount of the magnet powder and the binder in total in the mixture 12 after the addition is within a range of 1 wt % through 40 wt %, more preferably 2 wt % through 30 wt %, or still more preferably 3 wt % through 20 wt %. Here, the addition of the binder is performed in an atmosphere composed of inert gas such as nitrogen gas, Ar gas or He gas. Here, at mixing the magnet powder and the binder together, the magnet powder and the binder are, for instance, respectively put into an organic solvent and stirred with a stirrer. After stirring, the organic solvent containing the magnet powder and the binder is heated to volatilize the organic solvent, so that the mixture 12 is extracted. It is preferable that the binder and the magnet powder is mixed under an atmosphere composed of inert gas such as nitrogen gas, Ar gas, helium He gas or the like. Further, specifically when the magnet powder is milled by a wet method, the binder may be added to an organic solvent used for the milling and kneaded, and thereafter the organic solvent is volatilized to obtain the mixture 12, without isolating the magnet powder out of the organic solvent used for the milling.

Subsequently, the green sheet is prepared through forming the mixture into a sheet-like shape. Specifically, in the hot-melt molding, the mixture 12 is heated to melt, and turned into a fluid state, and then coats the supporting base 13 such as a separator. Thereafter, the mixture 12 coating the supporting base 13 is left to cool and solidify, so that the green sheet 14 can be formed in a long sheet fashion on the supporting base 13. Incidentally, the appropriate temperature for thermally melting the mixture 12 differs depending on the kind or amount of binder to be used, but is set here within a range of 50 through 300 degrees Celsius. However, the temperature needs to be higher than the melting point of the binder to be used. Incidentally, when the slurry molding is employed, the magnet powder and the binder are dispersed in an organic solvent such as toluene to obtain slurry, and a supporting base 13 such as a separator is coated with the slurry. Thereafter, the organic solvent is dried to volatilize so as to produce the green sheet 14 in a long sheet fashion on the supporting base 13.

Here, the coating method of the molten mixture 12 is preferably a method excellent in layer thickness controllability, such as a slot-die system and a calender roll system. For instance, in the slot-die system, the mixture 12 heated to melt into a fluid state is extruded by a gear pump to put into the die, and then coating is performed. In the calender roll system, a predetermined amount of the mixture 12 is enclosed in a gap between two heated rolls, and the supporting base 13 is coated with the mixture 12 melted by the heat of the rolls, while the rolls are rotated. As supporting base 13, a silicone-treated polyester film is used, for instance. Further, a defoaming agent or a heat and vacuum defoaming method may preferably be employed in conjunction therewith to sufficiently perform defoaming treatment so that no air bubbles remain in a layer of coating. Further, instead of coating the supporting base 13, extrusion molding may be employed that molds the molten mixture 12 into a sheet and extrudes the sheet-like mixture 12 onto the supporting base 13, so that a green sheet 14 is formed on the supporting base 13.

Figure 3:
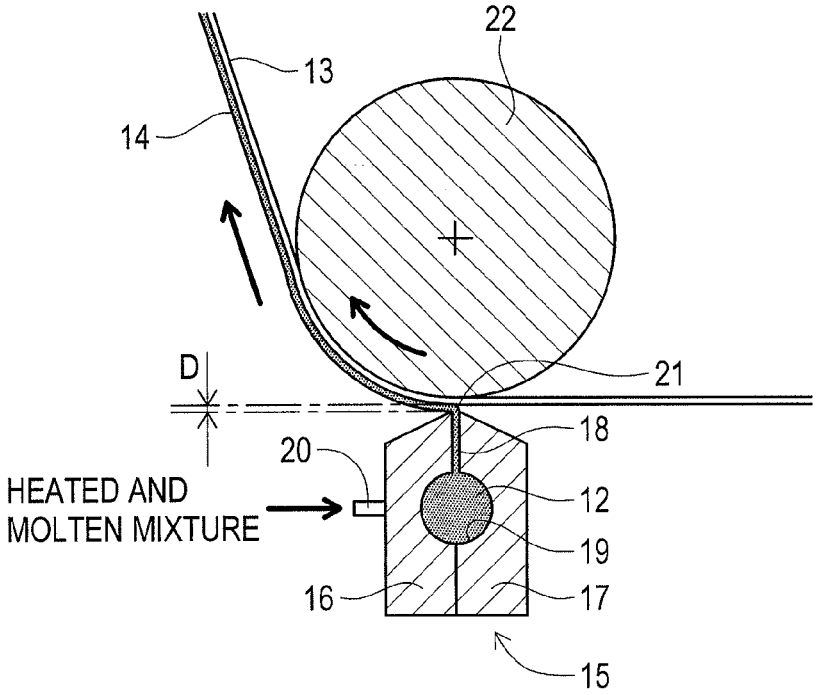
FIG. 3 is an explanatory diagram specifically illustrating a formation process of the green sheet in the manufacturing process of the permanent magnet according to the invention.

Here will be given a detailed description of the formation process of a green sheet 14 employing a slot-die system referring to FIG. 3. FIG. 3 is an explanatory diagram illustrating the formation process of the green sheet 14 employing the slot-die system.

As illustrated in FIG. 3, a slot die 15 used for the slot-die system is formed by putting blocks 16 and 17 together. There, a gap between the blocks 16 and 17 serves as a slit 18 and a cavity (liquid pool) 19. The cavity 19 communicates with a die inlet 20 formed in the block 17. Further, the die inlet 20 is connected to a coating fluid feed system configured with the gear pump and the like (not shown), and the cavity 19 receives the feed of metered fluid-state mixture 12 through the die inlet 20 by a metering pump and the like (not shown). Further, the fluid-state mixture 12 fed to the cavity 19 is delivered to the slit 18, and discharged at a predetermined coating width from a discharge outlet 21 of the slit 18, with pressure which is uniform in transverse direction in a constant amount per unit of time. Meanwhile, the supporting base 13 is conveyed along the rotation of a coating roll 22 at a predetermined speed. As a result, the discharged fluid-state mixture 12 is laid down on the supporting base 13 with a predetermined thickness. Thereafter, the mixture 12 is left to cool and solidify, so that a long-sheet-like green sheet 14 is formed on the supporting base 13.

Further, in the formation process of the green sheet 14 by the slot-die system, it is desirable to measure the actual sheet thickness of the green sheet 14 after coating, and to perform feed back control of a gap D between the slot die 15 and the supporting base 13 based on the measured thickness. Further, it is desirable to minimize the variation in feed rate of the fluid-state mixture 12 supplied to the slot die 15 (for instance, to suppress the variation within plus or minus 0.1%), and in addition, to also minimize the variation in coating speed (for instance, suppress the variation within plus or minus 0.1%). As a result, thickness precision of the green sheet can further be improved. Incidentally, the thickness precision of the formed green sheet is within a margin of error of plus or minus 10% with reference to a designed value (for instance, 1 mm), preferably within plus or minus 3%, or more preferably within plus or minus 1%. Alternatively, in the calender roll system, the film thickness of the transferred mixture 12 on the supporting base 13 can be controlled through controlling a calendering condition according to an actual measurement value.

Incidentally, a preset thickness of the green sheet 14 is desirably within a range of 0.05 mm through 20 mm. If the thickness is set to be thinner than 0.05 mm, it becomes necessary to laminate many layers, which lowers the productivity.

Next, magnetic field orientation is carried out to the green sheet 14 formed on the supporting base 13 by the above mentioned hot-melt molding. To begin with, the green sheet 14 conveyed together with the supporting base 13 is heated to soften. Incidentally, the appropriate temperature and duration for heating the green sheet 14 differ depending on the type or amount of the binder, but can be tentatively set, for instance, at 100 through 250 degrees Celsius, and 0.1 through minutes, respectively. However, for the purpose of softening the green sheet 14, the temperature needs to be equal to or higher than the glass transition point or melting point of the binder to be used. Further, the heating method for heating the green sheet 14 may be such a method as heating by a hot plate, or heating using a heat carrier (silicone oil) as a heat source, for instance. Further, magnetic field orientation is performed by applying magnetic field in an in-plane and machine direction of the green sheet 14 that has been softened by heating. The intensity of the applied magnetic field is 5000 [Oe] through 150000 [Oe], or preferably 10000 [Oe] through 120000 [Oe]. As a result, c-axis (axis of easy magnetization) of each magnet crystal grain included in the green sheet 14 is aligned in one direction. Incidentally, the application direction of the magnetic field may be an in-plane and transverse direction of the green sheet 14. Further, magnetic field orientation may be simultaneously performed to plural pieces of the green sheet 14.

Further, as to the application of the magnetic field to the green sheet 14, the magnetic field may be applied simultaneously with the heating, or the magnetic field may be applied after the heating and before the green sheet 14 solidifies. Further, the magnetic field may be applied before the green sheet 14 formed by the hot-melt molding solidifies. In such a case, the need of the heating process is eliminated.

Figure 4:
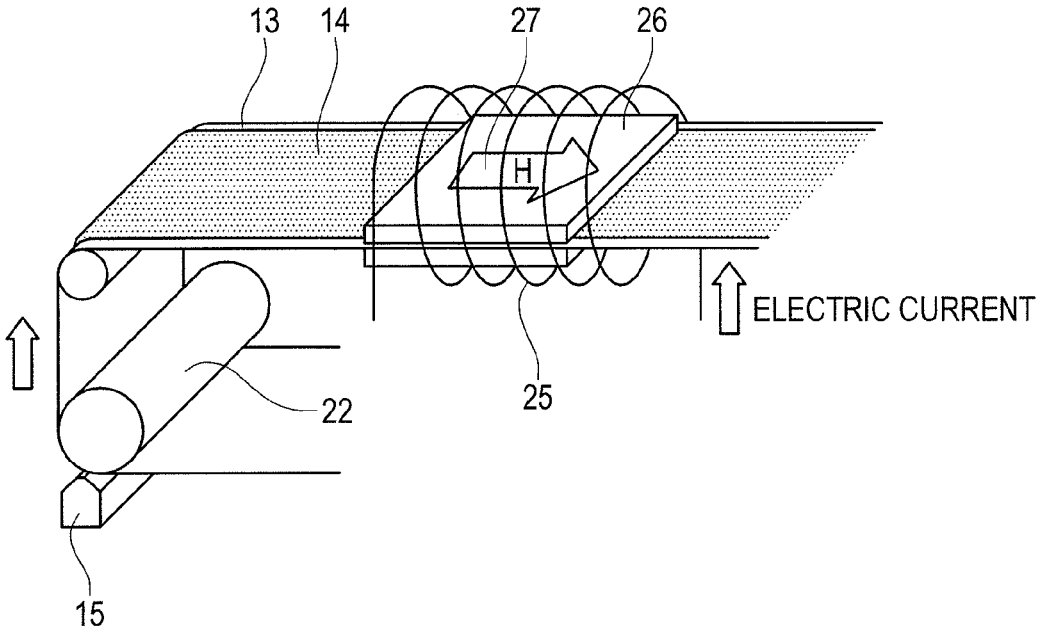
FIG. 4 is an explanatory diagram specifically illustrating a heating process and a magnetic field orientation process of the green sheet in the manufacturing process of the permanent magnet according to the invention.

Next, there will be described on a heating process and a magnetic field orientation process of the green sheet 14 in more detail, referring to FIG. 4. FIG. 4 is an explanatory diagram illustrating a heating process and a magnetic field orientation process of the green sheet 14. Referring to FIG. 4, there will be discussed an example which carries out the heating process and the magnetic field orientation simultaneously.

As shown in FIG. 4, heating and magnetic field orientation are performed on the green sheet 14 formed by the above described slot-die system into a long-sheet-like shape and continuously conveyed by a roll. That is, apparatuses for heating and magnetic field orientation are arranged at the downstream side of a coating apparatus (such as slot-die apparatus) so as to perform heating and magnetic field orientation subsequent to the coating process.

More specifically, a solenoid 25 is arranged at the downstream side of the slot die 15 or the coating roll 22 so that the green sheet 14 and the supporting base 13 being conveyed together pass through the solenoid 25. Further, inside the solenoid 25, hot plates 26 are arranged as a pair on upper and lower sides of the green sheet 14. While heating the green sheet 14 by the hot plates 26 arranged as a pair on the upper and lower sides, electrical current is applied to the solenoid 25 and magnetic field is generated in an in-plane direction (i.e., direction parallel to a sheet surface of the green sheet 14) as well as a machine direction of the long-sheet-like green sheet 14. Thus, the continuously-conveyed green sheet 14 is softened through heating, and magnetic field (H) is applied to the softened green sheet 14 in the in-plane and machine direction of the green sheet 14 (arrow 27 direction in FIG. 4). Thereby, homogeneous and optimized magnetic field orientation can be performed on the green sheet 14. Especially, application of magnetic field in the in-plane direction thereof can prevent surface of the green sheet 14 from bristling up.

Further, the green sheet 14 subjected to the magnetic field orientation is preferably cooled and solidified under the conveyed state, for the sake of higher efficiency at manufacturing processes.

Incidentally, when performing the magnetic field orientation in an in-plane and transverse direction of the green sheet 14, the solenoid 25 is replaced with a pair of magnetic coils arranged on the right and left sides of the conveyed green sheet 14. Through energizing both magnetic coils, a magnetic field can be generated in an in-plane and transverse direction of the long sheet-like green sheet 14.

Figure 5:
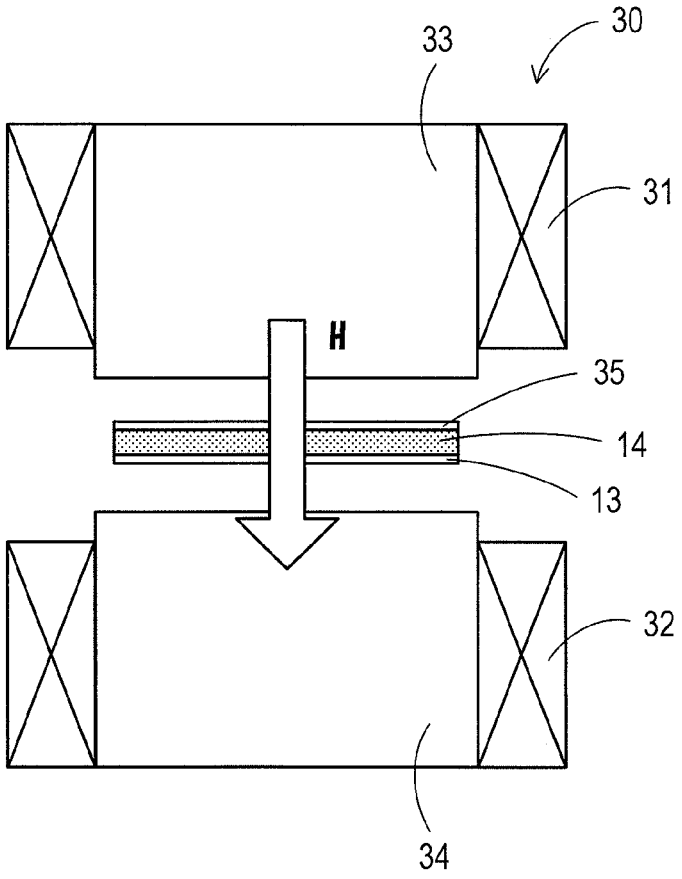
FIG. 5 is a diagram illustrating an example of the magnetic field orientation in a direction perpendicular to a plane of the green sheet.

Further, the magnetic field may be oriented in a direction perpendicular to a plane of the green sheet 14. When orienting the magnetic field in the direction perpendicular to a plane of the green sheet 14, there may be used, for instance, a magnetic field application apparatus using pole pieces, etc. Specifically, as illustrated in FIG. 5, a magnetic field application apparatus 30 using pole pieces has two ring-like coil portions 31, 32, and two substantially columnar pole pieces 33, 34. The coil portions 31, 32 are arranged in parallel with each other and coaxially aligned. The pole pieces 33, 34 are arranged inside ring holes of the coil portions 31, 32, respectively. The magnetic field application apparatus 30 is arranged to have a predetermined clearance to a green sheet 14 being conveyed. The coil portions 31, 32 are energized to generate a magnetic field (H) in the direction perpendicular to the plane of the green sheet 14, so that the green sheet 14 is subjected to the magnetic field orientation. However, in the case where the magnetic field is applied in the direction perpendicular to the plane of the green sheet 14, a film 35 is desirably laminated on top of the green sheet 14, on a surface opposite to the surface with the supporting base 13 laminated, as shown in FIG. 5. The surface of the green sheet 14 can thereby be prevented from bristling up.

Figure 6:
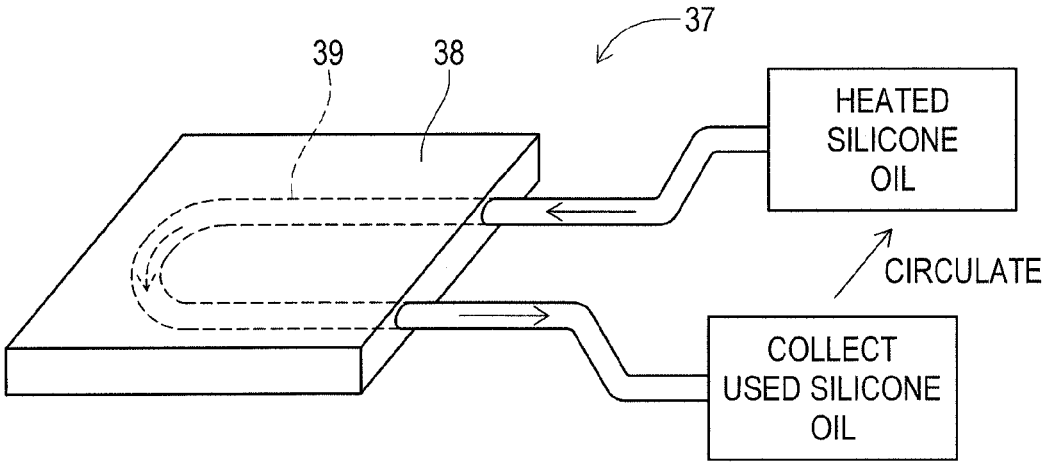
FIG. 6 is an explanatory diagram illustrating a heating device using a heat carrier (silicone oil).

Further, instead of the heating method that uses the above-mentioned hot plates 26, there may be employed a heating method that uses a heat carrier (silicone oil) as a heat source. FIG. 6 is an explanatory diagram illustrating a heating device 37 using a heat carrier.

As shown in FIG. 6, the heating device 37 has a flat plate member 38 as a heater element. The flat plate member 38 has a substantially U-shaped channel 39 formed inside thereof, and silicone oil heated to a predetermined temperature (for instance, 100 through 300 degrees Celsius) is circulated inside the channel 39, as a heat carrier. Then, in place of the hot plates 26 illustrated in FIG. 4, the heating devices 37 are arranged inside the solenoid 25 as a pair on the upper and lower sides of the green sheet 14. As a result, the flat plate members made hot by the heat carrier heats and softens the continuously conveyed green sheet 14. The flat plate member 38 may make direct contact with the green sheet 14, or may have a predetermined clearance to the green sheet 14. Then a magnetic field is applied to the green sheet 14 in an in-plane and machine direction thereof (direction of arrow 27 in FIG. 4) by the solenoid 25 arranged around the softened green sheet 14, so that the green sheet 14 can be optimally magnetized to have a uniform magnetic field orientation. Unlike a common hot plate 26, there is no internal electric heating cable in such a heating device 37 employing a heat carrier as shown in FIG. 6. Accordingly, even arranged inside a magnetic field, the heating device 37 does not induce a Lorentz force which may cause vibration or breakage of an electric heating cable, and thereby optimal heating of the green sheet 14 can be realized. Further, heat control by electric current may involve a problem that the ON or OFF of the power causes the electric heating cable to vibrate, resulting in fatigue fracture thereof. However, such a problem can be resolved by using a heating device 37 with a heat carrier as a heat source.

Here, the green sheet 14 may be formed using highly fluid liquid material such as slurry, by a conventional slot-die system or a doctor blade system, without employing the hot-melt molding. In such a case, when the green sheet 14 is conveyed into and exposed to the gradients of magnetic field, the magnet powder contained in the green sheet 14 is attracted to a stronger magnetic field. Thereby, liquid distribution of the slurry forming the green sheet 14 becomes imbalanced, resulting in the green sheet 14 with problematic unevenness in thickness. In contrast, in the case where the hot-melt molding is employed for forming the mixture 12 into a green sheet 14 as in the present invention, the viscosity of the mixture 12 reaches several tens of thousands Pa·s in the vicinity of the room temperature. Thus, imbalanced distribution of magnet powder can be prevented at the time the green sheet 14 is exposed to the gradients of magnetic field. Further, the viscosity of the binder therein lowers as the green sheet 14 is conveyed into a homogenous magnetic field and heated, and uniform c-axis orientation becomes attainable merely by the rotary torque in the homogeneous magnetic field.

Further, if the green sheet 14 is formed using highly fluid liquid material such as slurry by a conventional slot-die system or a doctor blade system without employing the hot-melt molding, problematic bubbles are generated at a drying process by evaporation of an organic solvent included in the slurry, when a sheet exceeding 1 mm thick is to be manufactured. Further, the duration of the drying process may be extended in an attempt to suppress bubbles. However, in such a case, the magnet powder is caused to precipitate, resulting in imbalanced density distribution of the magnet powder with regard to the gravity direction. This may lead to warpage of the permanent magnet after sintering. Accordingly, in the formation from the slurry, the maximum thickness is virtually restricted, and a green sheet 14 needs to be equal to or thinner than 1 mm thick and be laminated thereafter. However, in such a case, the binder cannot be sufficiently intermingled. This causes delamination at the binder removal process (calcination process), leading to degradation in the orientation in the c-axis (axis of easy magnetization), namely, decrease in residual magnetic flux density (Br). In contrast, in the case where the mixture 12 is formed into a green sheet 14 using hot-melt molding as in the present invention, as the mixture 12 is free from an organic solvent, there is no fear of such bubbles as mentioned in the above, even if a sheet over 1 mm thick is prepared. Further, the binder is well intermingled, and no delamination occurs at the binder removal process.

Further, if plural pieces of green sheet 14 are simultaneously exposed to the magnetic field, for instance, the plural pieces of green sheet 14 stacked in multiple layers (for instance, six layers) are continuously conveyed, and the stacked multiple layers of green sheet 14 are made to pass through inside the solenoid 25. Thus, the productivity can be improved.

Then, the green sheet 14 is die-cut into a desired product shape (for example, the fan-like shape shown in FIG. 1) to produce a formed body 40.

Thereafter, the formed body 40 thus produced is held at a binder-decomposition temperature for several hours (for instance, five hours) in a non-oxidizing atmosphere (specifically in this invention, a hydrogen atmosphere or a mixed gas atmosphere of hydrogen and inert gas) at a pressure higher than the normal atmospheric pressure (for instance, 0.2 MPa or higher, such as 0.5 MPa, or 1.0 MPa), and a calcination process is performed. The hydrogen feed rate during the calcination is, for instance, 5 L/min, if the calcination is performed in the hydrogen atmosphere. By the calcination process, the binder can be decomposed into monomers through depolymerization reaction, released and removed therefrom. Namely, so-called decarbonization is performed in which carbon content in the formed body 40 is decreased. Furthermore, the calcination process is to be performed under such a condition that carbon content in the formed body 40 is 2000 ppm or lower, or more preferably 1000 ppm or lower. Accordingly, it becomes possible to sinter the permanent magnet 1 densely as a whole in the sintering process that follows, and the decrease in the residual magnetic flux density or in the coercive force can be prevented. Furthermore, if the pressure higher than the atmospheric pressure is employed with regard to a pressurization condition at the calcination process, the pressure is preferably 15 MPa or lower. Incidentally, the condition of 0.2 Mpa or higher pressurization specifically helps reduce the carbon content.

The temperature for decomposing the binder is determined based on the analysis of the binder decomposition products and decomposition residues. In particular, the temperature range to be selected is such that, when the binder decomposition products are trapped, no decomposition products except monomers are detected, and when the residues are analyzed, no products due to the side reaction of remnant binder components are detected. The temperature differs depending on the type of binder, but may be set at 200 through 900 degrees Celsius, or more preferably 400 through 600 degrees Celsius (for instance, 600 degrees Celsius).

Further, in the case where the magnet raw material is milled in an organic solvent by wet-milling, the calcination process is performed at a decomposition temperature of the organic compound composing the organic solvent as well as the binder decomposition temperature. Accordingly, it is also made possible to remove the residual organic solvent. The decomposition temperature for an organic compound is determined based on the type of organic solvent to be used, but the above binder decomposition temperature is basically sufficient to thermally decompose the organic compound.

Further, a dehydrogenation process may be carried out through successively holding, in a vacuum atmosphere, the formed body 40 calcined at the calcination process. In the dehydrogenation process, $NdH_3$ (having high reactivity level) in the formed body 40 created at the calcination process is gradually changed, from $NdH_3$ (having high reactivity level) to $NdH_2$ (having low reactivity level). As a result, the reactivity level is decreased with respect to the formed body 40 activated by the calcination process. Accordingly, if the formed body 40 calcined at the calcination process is later moved into the atmosphere, Nd therein is prevented from combining with oxygen, and the decrease in the residual magnetic flux density and coercive force can also be prevented. Further, there can be expected an effect of putting the crystal structure of the magnet from those with $NdH_2$ or the like back to the structure of $Nd_2Fe_{14}B$.

Thereafter, a sintering process is performed in which the formed body 40 calcined in the calcination process is sintered. Incidentally, a sintering method of the formed body 40 may include, besides generally-used vacuum sintering, the pressure sintering where the pressurized formed body 40 is sintered. For instance, when the vacuum sintering is performed, the temperature is raised to the sintering temperature of approximately 800 through 1080 degrees Celsius in a given rate of temperature increase and held for approximately 0.1 through 2.0 hours. During this period, vacuum sintering is performed, and the degree of vacuum is preferably equal to or smaller than 5 Pa, or preferably equal to or smaller than $10^{-2}$ Pa. The formed body 40 is then cooled down, and again undergoes a heat treatment in 300 through 1000 degrees Celsius for two hours. As a result of the sintering, the permanent magnet 1 is manufactured.

Meanwhile, the pressure sintering includes, for instance, hot pressing, hot isostatic pressing (HIP), high pressure synthesis, gas pressure sintering, spark plasma sintering (SPS) and the like. However, it is preferable to adopt the spark plasma sintering which is uniaxial pressure sintering in which pressure is uniaxially applied and also in which sintering is preformed by electric current sintering so as to prevent grain growth of the magnet particles during the sintering and also to prevent warpage formed in the sintered magnets. When the SPS is performed, it is preferable that the pressure value is set, for instance, at 0.01 MPa through 100 MPa, and the temperature is raised to approximately 940 degrees Celsius at a rate of 10 degrees C./min. in a vacuum atmosphere of several Pa or lower, and held for five minutes. The formed body 40 is then cooled down, and again undergoes a heat treatment in 300 through 1000 degrees Celsius for two hours. As a result of the sintering, the permanent magnet 1 is manufactured.

Figure 7:
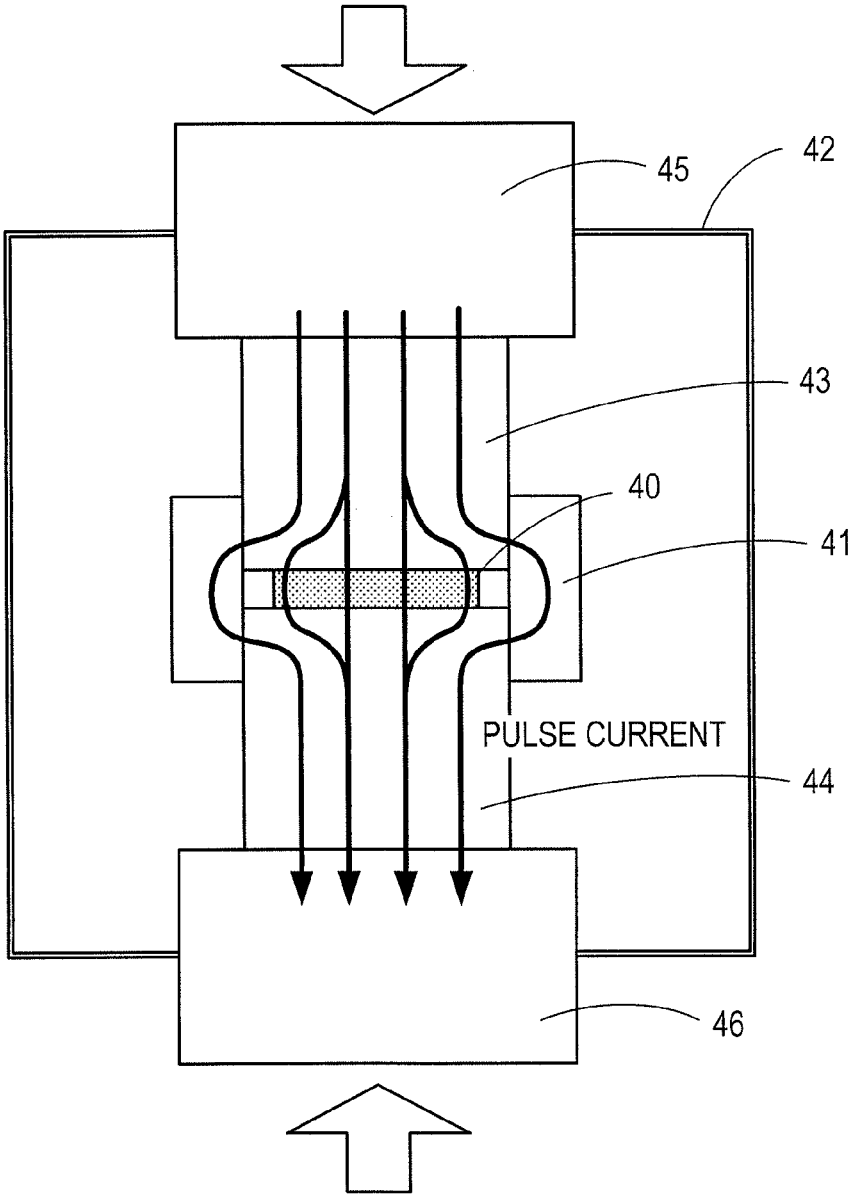
FIG. 7 is an explanatory diagram specifically illustrating a pressure sintering process of the green sheet in the manufacturing process of the permanent magnet according to the invention.

Here will be given a detailed description of the pressure sintering process of a formed body 40 using the SPS method, referring to FIG. 7. FIG. 7 is a schematic diagram depicting the pressure sintering process of the formed body 40 using the SPS method.

When performing the spark plasma sintering as illustrated in FIG. 7, first, the formed body 40 is put in a graphite sintering die 41. Incidentally, the above calcination process may also be performed under this state where the formed body 40 is put in the sintering die 41. Then, the formed body 40 put in the sintering die 41 is held in a vacuum chamber 42, and an upper punch 43 and a lower punch 44 also made of graphite are set thereat. After that, using an upper punch electrode 45 coupled to the upper punch 43 and a lower punch electrode 46 coupled to the lower punch 44, pulsed DC voltage/current being low voltage and high current is applied. At the same time, a load is applied to the upper punch 43 and the lower punch 44 from upper and lower directions using a pressurizing mechanism (not shown). As a result, the formed body 40 put inside the sintering die 41 is sintered while being pressurized. Further, the spark plasma sintering is preferably executed to a plurality of formed bodies (for instance, ten formed bodies) 40 simultaneously, so that the productivity may be improved. Incidentally, at the simultaneous spark plasma sintering to the plurality of formed bodies 40, the plurality of formed bodies 40 may be put in one sintering space, or may be respectively arranged in different sintering spaces. Incidentally, in the case that the plurality of formed bodies 40 are respectively arranged in different sintering spaces, an SPS apparatus provided with a plurality of sintering spaces is used to execute sintering. There, the upper punch 43 and the lower punch 44 for pressing the formed bodies 40 are configured to be integrally used for the plurality of sintering spaces (so that the pressure can be applied simultaneously by the upper punch 43 and the lower punch 44 which are integrally operated).

Incidentally, the detailed sintering condition is as follows:

Pressure value: 1 MPa

Sintering temperature: raised by 10 deg. C. per min. up to 940 deg. C. and held for 5 min.

Atmosphere: vacuum atmosphere of several Pa or lower.

Embodiments according to the present invention will now be described referring to comparative examples for comparison.

Embodiment 1

In the embodiment, there is used an Nd—Fe—B-based magnet, and alloy composition thereof is Nd/Fe/B=32.7/65.96/1.34 in wt %. Polyisobutylene (PIB) has been used as binder. The magnet material has been milled wet using toluene as the organic solvent. A green sheet is obtained through coating the base with the heated and molten mixture by a slot-die system. Further, a calcination process has been performed by holding the green sheet for five hours at 600 degrees Celsius, in a hydrogen atmosphere pressurized at 0.5 MPa, which is higher than normal atmospheric pressure (specifically in this embodiment, it is assumed that the atmospheric pressure at manufacturing is standard atmospheric pressure (approx. 0.1 MPa)). The hydrogen feed rate during the calcination is 5 L/min. The green sheet has been sintered by SPS method (at pressure value of 1 MPa, raising sintering temperature by 10 degrees Celsius per minute up to 940 degrees Celsius and holding it for 5 minutes). Other processes are the same as the processes in [Method for Manufacturing Permanent Magnet] mentioned above.

Embodiment 2

A styrene-isoprene block copolymer (SIS) obtained by copolymerization of styrene and isoprene has been used as binder to be mixed. The pressure at calcination has been 0.5 MPa. Other conditions are the same as the conditions in embodiment 1.

Embodiment 3

Polyisoprene (isoprene rubber, or IR) obtained by polymerization of isoprene has been used as binder to be mixed. The pressure at calcination has been 0.5 MPa. Other conditions are the same as the conditions in embodiment 1.

Embodiment 4

Polybutadiene (butadiene rubber, or BR) obtained by polymerization of 1,3-butadiene has been used as binder to be mixed. The pressure at calcination has been 0.5 MPa. Other conditions are the same as the conditions in embodiment 1.

Embodiment 5

A styrene-butadiene block copolymer (SBS) obtained by copolymerization of styrene and butadiene has been used as binder to be mixed. The pressure at calcination has been 0.5 MPa. Other conditions are the same as the conditions in embodiment 1.

Comparative Example 1

Polyisobutylene (PIB) has been used as binder to be mixed. The pressure at calcination has been normal atmospheric pressure (approx. 0.1 MPa). Other conditions are the same as the conditions in embodiment 1.

Comparative Example 2

A styrene-isoprene block copolymer (SIS) has been used as binder to be mixed. The pressure at calcination has been normal atmospheric pressure (approx. 0.1 MPa). Other conditions are the same as the conditions in embodiment 1.

Comparative Example 3

Polyisoprene (isoprene rubber, or IR) obtained by polymerization of isoprene has been used as binder to be mixed. The pressure at calcination has been normal atmospheric pressure (approx. 0.1 MPa). Other conditions are the same as the conditions in embodiment 1.

Comparative Example 4

Polybutadiene (butadiene rubber, or BR) obtained by polymerization of 1,3-butadiene has been used as binder to be mixed. The pressure at calcination has been normal atmospheric pressure (approx. 0.1 MPa). Other conditions are the same as the conditions in embodiment 1.

Comparative Example 5

A styrene-butadiene block copolymer (SBS) obtained by copolymerization of styrene and butadiene has been used as binder to be mixed. The pressure at calcination has been normal atmospheric pressure (approx. 0.1 MPa). Other conditions are the same as the conditions in embodiment 1.

Comparative Example 6

A permanent magnet has been manufactured without the calcination process. Other conditions are the same as the conditions in embodiment 1.

Comparative Example 7

Polybutylmethacrylate has been used as binder to be mixed. The pressure at calcination has been normal atmospheric pressure (approx. 0.1 MPa). Other conditions are the same as the conditions in embodiment 1.

External Appearance of Green Sheet of Embodiment

Figure 8:
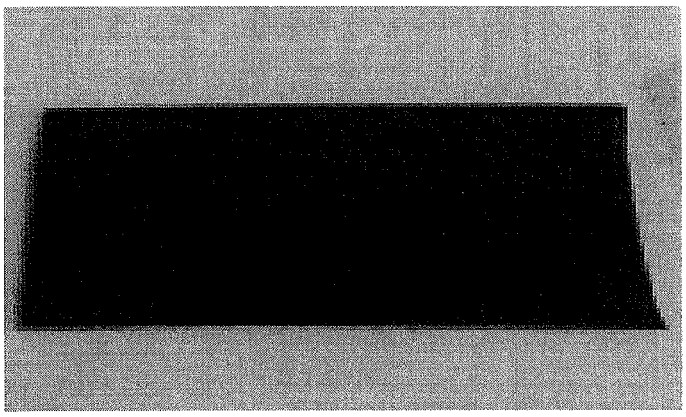
FIG. 8 is a view depicting an external appearance of a green sheet according to an embodiment.

Here, FIG. 8 depicts an external appearance of a green sheet of the embodiment 1 after magnetic field orientation. As shown in FIG. 8, no bristling-up can be observed with respect to the surface of the green sheet after magnetic field orientation of the embodiment 1. Accordingly, the sintered permanent magnet of the embodiment 1, where the green sheet is punched out to form a desired shape as shown in FIG. 8, requires no adjustment process so that the manufacturing process can be simplified. The permanent magnet of the embodiment can thereby be manufactured with dimensional accuracy.

Comparative Discussion of Embodiments with Comparative Examples

There have been measured oxygen concentration [ppm] and carbon concentration [ppm] remaining in respective magnets of embodiments 1 through 5 and comparative examples 1 through 7. Further, there have been measured residual magnetic flux density [kG] and coercive force [kOe] regarding the embodiments 1 through 5 and the comparative examples 1 through 7. FIG. 9 shows measurement results regarding respective embodiments and comparative examples.

As shown in FIG. 9, referring to the embodiments 1 through 5 and the comparative examples 1 through 7, it is apparent that carbon content contained in the magnet can be reduced significantly in a case of performing a calcination process, in comparison with a case of not performing a calcination process. Specifically, in the embodiments 1 through 5, the carbon content remaining in the magnet particles can be reduced to 400 ppm or lower, and further, when PIB or SIS is used as the binder, the carbon content can be reduced to 250 ppm or lower. That is, it is apparent that the binder can thermally decompose by the calcination process so as to bring about so-called decarbonization in which carbon content in the calcined body is reduced, and that using PIB or SIS as the binder specifically can make thermal decomposition and decarbonization easier than using other binders. As a result, the entire magnet can be densely sintered and degradation of the coercive force can be prevented.

Further, referring to the embodiments 1 through 5 and the comparative examples 1 through 5, it is apparent that carbon content contained in the magnet particles can further be reduced in a case of a calcination process under higher pressure, in comparison with a case under normal atmospheric pressure, even if the same type of binder is added. That is, the calcination process enables so-called decarbonization in which the binder thermally decomposes and the carbon content in the calcined body is reduced. Specifically, the calcination process under pressure higher than normal atmospheric pressure can make the thermal decomposition and decarbonization easier to occur in the calcination process. As a result, the entire magnet can be densely sintered and degradation of the coercive force can be prevented.

It is apparent that the oxygen content remaining in the magnet can be reduced significantly in a case of using such a binder having no oxygen atoms as PIB or SIS, in comparison with a case of using such a binder having oxygen atoms as polybutylmethacrylate, according to the comparative example 7. Specifically, the oxygen content remaining in the sintered magnet can be reduced to 2000 ppm or lower. Consequently, such low oxygen content can prevent Nd from binding to oxygen to form a Nd oxide and also prevent alpha iron from separating out. Accordingly, as shown in FIG. 9, cases of using polyisobutylene etc. as binder also show higher values of residual magnetic flux density or coercive force.

As described in the above, according to the permanent magnet 1 and the method for manufacturing the permanent magnet 1 directed to the embodiments, magnet material is milled into magnet powder. Next, the magnet powder and a binder are mixed to prepare a mixture 12. Next, the thus prepared mixture 12 is formed into long-sheet-like shape so as to obtain a green sheet 14. Thereafter, the green sheet 14 thus obtained is exposed to magnetic field for magnetic field orientation, and then the green sheet 14 is held for several hours at 200 through 900 degrees Celsius under a non-oxidizing atmosphere at a pressure higher than normal atmospheric pressure for a calcination process. Thereafter, the green sheet 14 is sintered at a sintering temperature to produce a permanent magnet 1. The green sheet 14 uniformly contracts at sintering and thus no deformations such as warpage and depressions occur there. Further, uneven pressure cannot occur at the pressurizing process, which eliminates the need of conventional adjustment process after sintering and simplifies the manufacturing process. Thereby, a permanent magnet can be manufactured with dimensional accuracy. Further, even if such permanent magnets are made thin in the course of manufacturing, increase in the number of manufacturing processes can be avoided without lowering a material yield.

Further, before the step of sintering the green sheet 14, the binder is decomposed and removed from the green sheet 14 by holding the green sheet 14 for a predetermined length of time at binder decomposition temperature in a non-oxidizing atmosphere, so that the carbon content in the magnet can be reduced previously. Thereby, the entirety of the magnet can be sintered densely without making a gap between a main phase and a grain boundary phase in the sintered magnet and decline of the coercive force can be avoided.

As the hot-melt molding is employed to produce a green sheet 14, imbalanced fluid distribution, namely, problematic unevenness in thickness of the green sheet 14 can be prevented at magnetic field orientation, in comparison with the slurry molding. Further, the binder is well intermingled, so that the possibility of delamination can be eliminated in the binder removal process. Further, considerable alpha iron does not separate out in the main phase of the sintered magnet and serious deterioration of magnetic properties can be avoided. Specifically, calcination in a non-oxidizing atmosphere at the pressure higher than normal atmospheric pressure can facilitate binder decomposition and removal. Thereby, the carbon content in magnet particles can further be reduced. Further, even in a case of wet-milling using an organic solvent or adding an organometallic compound such as alkoxide or metal complex, the remaining organic compound can thermally decompose to release the carbon contained in the magnet particles (to reduce the carbon content) before sintering.

Further, if the calcination is performed under a hydrogen atmosphere or a mixed gas atmosphere of hydrogen and inert gas for a predetermined length of time at a temperature range of 200 through 900 degrees Celsius, it becomes possible to release the carbon contained in the magnet in a form of methane, and the carbon content in the magnet can be reduced more reliably.

Further, the oxygen content remaining in the sintered magnet can be reduced as the binder is produced by a resin made of a polymer or a copolymer consisting of monomers containing no oxygen atoms. Further, specifically, if a thermoplastic resin is used as the binder, the green sheet 14 once formed can be softened by heating, so that magnetic field orientation can be optimally performed.

Specifically, by using such a binder containing no oxygen atoms as polyisobutylene or a styrene-isoprene copolymer, the binder can be decomposed by calcination and the carbon content in the magnet particles as well as the oxygen content in the magnet can be reduced.

It is to be understood that the present invention is not limited to the embodiments described above, but may be variously improved and modified without departing from the scope of the present invention.

Further, milling condition for magnet powder, mixing condition, calcination condition, sintering condition, etc. are not restricted to conditions described in the embodiments. For instance, in the above described embodiments, the green sheet is formed in accordance with a slot-die system. However, a green sheet may be formed in accordance with other system or molding (e.g., calender roll system, comma coating system, extruding system, injection molding, die casting, doctor blade system, etc.). Further, magnet powder and a binder may be mixed with an organic solvent to prepare slurry and the prepared slurry may be formed into a sheet-like shape to produce the green sheet. In such a case, a binder other than a thermoplastic resin can be used. The calcination may be performed under an atmosphere other than hydrogen atmosphere, as long as it is a non-oxidizing atmosphere (for instance, nitrogen atmosphere, helium atmosphere, or argon atmosphere).

Although resin, long-chain hydrocarbon, and fatty acid methyl ester are mentioned as examples of binder in the embodiments, other materials may be used.

Further, the permanent magnet can be manufactured through calcining and sintering a formed body formed by a method other than a method that forms a green sheet (for instance, powder compaction). Even in such a case, the calcination process can facilitate the removal of carbon from carbon-containing substances remaining in the formed body (for instance, organic compounds remaining due to wet milling, or organometallic compounds added to magnet powder), other than the binder. Further, if the permanent magnet is to be manufactured through calcining and sintering a formed body formed by a method other than a method that forms a green sheet (for instance, powder compaction), the magnet powder before formation or compaction may be calcined, and the magnet powder being a calcined body may be formed or compacted into a formed body, and thereafter the formed body may be sintered to manufacture the permanent magnet. In this configuration, powdery magnet particles are calcined, so that the surface area of the magnet to be calcined is made larger in comparison with the case where magnet particles after formation into a desired shape are calcined. Accordingly, carbon content in the calcined body can be reduced more reliably.

Further, in the above embodiments, heating and magnetic field orientation of the green sheet 14 are simultaneously performed; however, the magnetic field orientation may be performed after heating and before solidifying the green sheet 14. Further, if the magnetic field orientation is performed before the formed green sheet 14 solidifies (that is, performed on the green sheet 14 in a softened state without the heating process), the heating process may be omitted.

Further, in the above embodiments, a slot-die coating process, a heating process and a magnetic field orientation process are performed consecutively. However, these processes need not be consecutive. Alternatively, the processes can be divided into two parts: the first part up to the slot-die coating process and the second part from the heating process and the processes that follow, and each of the two parts is performed consecutively. In such a case, the formed green sheet 14 may be cut at a predetermined length, and the green sheet 14 in a stationary state may be heated and exposed to the magnetic field for the magnetic field orientation.

Description of the present invention has been given by taking the example of the Nd—Fe—B-based magnet. However, other kinds of magnets may be used (for instance, cobalt magnet, alnico magnet, ferrite magnet, etc.). Further, in the alloy composition of the magnet in the embodiments of the present invention, the proportion of the Nd component is larger than that in the stoichiometric composition. However, the proportion of the Nd component may be the same as in the stoichiometric composition. Further, the present invention can be applied not only to anisotropic magnet but also to isotropic magnet. In the case of the isotropic magnet, the magnetic field orientation process for the green sheet 14 can be omitted.

DESCRIPTION OF REFERENCE NUMERALS AND SIGNS

1 permanent magnet
11 bead mill
12 mixture
13 supporting base
14 green sheet
15 slot die
25 solenoid
26 hot plate
37 heating device
40 formed body

The invention claimed is:

1. A manufacturing method of a rare-earth permanent magnet comprising, in order, steps of:

milling magnet material into magnet powder;

mixing the magnet powder with a binder to obtain a mixture;

forming the mixture into a formed body;

calcining the formed body in a non-oxidizing atmosphere, wherein the calcining comprises a calcination process during which the formed body is held at a temperature in a range of 200 degrees Celsius to 900 degrees Celsius and the on-oxidizing atmosphere is pressurized at 0.5 MPa or higher so that a residual oxygen content contained in the formed body after sintering is 5000 ppm or less; and holding the calcined formed body at a sintering temperature so as to sinter the calcined formed body, wherein the binder consists of a resin that is made of a polymer or a copolymer consisting essentially of one or more kinds of monomers expressed with a general formula (1):

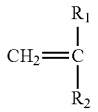

(1)

wherein $R_1$ and $R_2$ represent a hydrogen atom, a lower alkyl group, a phenyl group or a vinyl group, and wherein the calcination process has a duration of several hours.

2. The manufacturing method of a rare-earth permanent magnet according to claim 1, wherein, in the step of calcining the formed body, the binder is decomposed and removed from the formed body.

3. The manufacturing method of a rare-earth permanent magnet according to claim 1, wherein, in the step of calcining the formed body, the formed body is held for at least the duration of the calcination process in a hydrogen atmosphere or a mixed gas atmosphere of hydrogen and inert gas.

4. The manufacturing method of a rare-earth permanent magnet according to claim 1, wherein, in the step of forming the mixture, the mixture is thermally melted and formed into the formed body.

5. The manufacturing method of a rare-earth permanent magnet according to claim 1, wherein the binder comprises: polyisobutylene; or a styrene-isoprene copolymer.

6. The manufacturing method of a rare-earth permanent magnet according to claim 1, wherein, in the step of milling magnet material, the magnet material is wet-milled in an organic solvent.

7. The manufacturing method of a rare-earth permanent magnet according to claim 6, wherein, in the step of calcining the formed body, an organic compound included in the organic solvent thermally decomposes and carbon therein is removed, while the binder decomposes and is removed from the formed body.

8. The manufacturing method of a rare-earth permanent magnet according to claim 1, wherein the duration of the calcination process is five hours.

9. The manufacturing method of a rare-earth permanent magnet according to claim 1, wherein the calcining further comprises:

increasing a pressure of the non-oxidizing atmosphere from standard atmospheric pressure to at least 0.5 MPa for the calcination process.

10. A manufacturing method of a rare-earth permanent magnet comprising, in order, steps of:

milling magnet material into magnet powder;

mixing the magnet powder with a binder to obtain a mixture;

forming the mixture into a formed body;

calcining the formed body in a non-oxidizing atmosphere, wherein during the calcining, the formed body is held at a temperature in a range of 200 degrees Celsius to 900 degrees Celsius and the non-oxidizing atmosphere is always pressurized at 0.5 MPa to 15 MPa so that a residual oxygen content contained in the formed body after sintering is 5000 ppm or less; and holding the calcined formed body at a sintering temperature so as to sinter the calcined formed body, wherein the binder consists of a resin that is made of a polymer or a copolymer consisting essentially of one or more kinds of monomers expressed with a general formula (1):

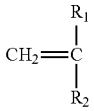

(1)

wherein $R_1$ and $R_2$ represent a hydrogen atom, a lower alkyl group, a phenyl group or a vinyl group.

11. The manufacturing method of a rare-earth permanent magnet according to claim 10, wherein the formed body is held at the temperature in the range of 200 degrees Celsius to 900 degrees Celsius and the non-oxidizing atmosphere is always pressurized at 0.5 MPa to 15 MPa for a duration of several hours.

12. The manufacturing method of a rare-earth permanent magnet according to claim 10, wherein the calcining further comprises:

increasing a pressure of the non-oxidizing atmosphere from standard atmospheric pressure to 0.5 MPa to 15 MPa.

13. A manufacturing method of a rare-earth permanent magnet comprising, in order, steps of:

milling magnet material into magnet powder;

mixing the magnet powder with a binder to obtain a mixture;

forming the mixture into a formed body;

calcining the formed body in a non-oxidizing atmosphere, wherein during the calcining, the non-oxidizing atmosphere is pressurized to 0.5 MPa to 15 MPa while the formed body is concurrently held at a temperature in a range of 200 degrees Celsius to 900 degrees Celsius for several hours so that a residual oxygen content contained in the formed body after sintering is 5000 ppm or less; and holding the calcined formed body at a sintering temperature so as to sinter the calcined formed body, wherein the binder consists of a resin that is made of a polymer or a copolymer consisting essentially of one or more kinds of monomers expressed with a general formula (1):

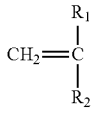

(1)

wherein $R_1$ and $R_2$ represent a hydrogen atom, a lower alkyl group, a phenyl group or a vinyl group.

14. The manufacturing method of a rare-earth permanent magnet according to claim 13, wherein the non-oxidizing atmosphere is pressurized to 0.5 MPa to 15 MPa and the formed body is concurrently held at the temperature in the range of 200 degrees Celsius to 900 degrees Celsius for a duration of five hours.

15. The manufacturing method of a rare-earth permanent magnet according to claim 13, wherein the calcining further comprises:

increasing a pressure of the non-oxidizing atmosphere from standard atmospheric pressure to 0.5 MPa to 15 MPa.

* * * * *